US010435964B2

(12) United States Patent
Magnuson et al.

(10) Patent No.: US 10,435,964 B2
(45) Date of Patent: Oct. 8, 2019

(54) MODULAR GRIPPERHEAD WITH EFFECTOR FOR A RACKER SYSTEM

(71) Applicant: Nabors Drilling Technologies USA, Inc., Houston, TX (US)

(72) Inventors: Christopher Magnuson, Houston, TX (US); Steven K. Deel, Cypress, TX (US); Predrag Radovanovic, Belgrade (RS); Djuric Miodrag, Belgrade (RS)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 15/790,458

(22) Filed: Oct. 23, 2017

(65) Prior Publication Data

US 2018/0126563 A1 May 10, 2018

Related U.S. Application Data

(60) Provisional application No. 62/418,488, filed on Nov. 7, 2016.

(51) Int. Cl.
*E21B 19/16* (2006.01)
*E21B 19/14* (2006.01)
*E21B 19/06* (2006.01)

(52) U.S. Cl.
CPC ..... *E21B 19/14* (2013.01); *E21B 19/06* (2013.01); *E21B 19/161* (2013.01); *E21B 19/168* (2013.01)

(58) Field of Classification Search
CPC .... E21B 19/164; E21B 19/162; E21B 19/161; E21B 19/16; E21B 19/163; E21B 19/18;
(Continued)

(56) References Cited

U.S. PATENT DOCUMENTS 2,450,934 A * 10/1948 Calhoun ..... E21B 19/164 166/77.53
2,544,639 A * 3/1951 Calhoun ..... E21B 19/168 81/57.16

(Continued)

FOREIGN PATENT DOCUMENTS

CA 2967040 A1 6/2016
CN 104389536 A * 3/2015 ..... E21B 19/14
JP 09137689 A * 5/1997

*Primary Examiner* — Gregory W Adams
(74) *Attorney, Agent, or Firm* — Haynes and Boone, LLP

(57) ABSTRACT

The systems, devices, and methods described herein relate to a modular gripperhead system for a drilling rig. The system includes a gripper having a first gripper arm and a second opposing gripper arm, each gripper arm having an inwardly facing gripping surface that forms at least a portion of a chamber sized to receive a portion of a cylindrical tubular, wherein the portion of the chamber has a longitudinal axis. The system also includes a grabber having a first grabber arm and a second grabber arm. Each grabber arm may be displaceable between a retracted position and an extended position in a direction along a first axis that is transverse to the longitudinal axis. The first and second grabber arms may be pivotable about a first and second pivot point between an open position sized to permit a portion of a cylindrical tubular to enter between the first and the second grabber arms and a closed position sized to secure a portion of a cylindrical tubular between the first and the second grabber arms.

19 Claims, 13 Drawing Sheets

(58) Field of Classification Search
CPC ..... E21B 19/20; E21B 19/24; E21B 19/14; E21B 19/155; B25J 15/0028; B25J 15/0052
USPC ..... 414/22.51–22.59, 22.61–22.69, 22.71
See application file for complete search history.

(56) References Cited

U.S. PATENT DOCUMENTS 2,705,614 A * 4/1955 McKibben ..... E21B 19/164 269/25
2,871,743 A * 2/1959 Kelley ..... E21B 19/163 81/57.2
3,392,609 A * 7/1968 Bartos ..... E21B 19/168 81/57.19
3,500,708 A * 3/1970 Wilson ..... E21B 19/163 81/57.34
3,803,953 A * 4/1974 Geczy ..... E21B 19/16 166/77.51
4,295,527 A * 10/1981 Russe ..... E21B 19/16 166/380
4,348,920 A * 9/1982 Boyadjieff ..... E21B 19/20 166/77.53
4,854,400 A * 8/1989 Simpson ..... E21B 15/003 175/85
4,879,802 A * 11/1989 Winkler ..... B23Q 3/1554 483/36
6,505,531 B2 * 1/2003 Stogner ..... E21B 19/18 81/57.16
6,966,385 B2 * 11/2005 Hemphill ..... E21B 19/165 166/380
7,036,396 B2 * 5/2006 Moe ..... E21B 19/168 81/57.2
7,178,612 B2 * 2/2007 Belik ..... E21B 19/00 175/162
7,249,639 B2 * 7/2007 Belik ..... E21B 19/00 175/162
8,464,613 B2 * 6/2013 Holladay ..... E21B 19/167 166/377
8,733,472 B2 5/2014 Magnuson
8,899,133 B1 * 12/2014 Somerville ..... E21B 19/165 29/252
9,051,782 B2 6/2015 Magnuson
9,097,072 B2 * 8/2015 Perez ..... E21B 19/165
9,354,623 B2 5/2016 Magnuson
9,394,751 B2 7/2016 Magnuson
9,562,407 B2 2/2017 Magnuson
9,643,206 B2 5/2017 Magnuson et al.
9,657,539 B2 5/2017 Gupta et al.
9,695,649 B2 7/2017 Magnuson et al.
9,739,071 B2 8/2017 Deel et al.
9,784,053 B2 10/2017 Magnuson
2012/0067642 A1 3/2012 Magnuson
2014/0202769 A1 7/2014 Magnuson
2014/0216815 A1 8/2014 Magnuson
2014/0299376 A1 * 10/2014 Bertelsen ..... E21B 19/168 175/24
2015/0086718 A1 3/2015 Magnuson et al.
2015/0090463 A1 4/2015 Gupta et al.
2015/0096764 A1 4/2015 Magnuson et al.
2015/0101826 A1 4/2015 Gupta et al.
2015/0232272 A1 8/2015 Magnuson
2015/0330162 A1 11/2015 Magnuson et al.
2016/0060979 A1 3/2016 Magnuson
2016/0060980 A1 3/2016 Magnuson
2016/0168928 A1 6/2016 Magnuson
2016/0168929 A1 6/2016 Magnuson et al.
2016/0251869 A1 9/2016 Deel et al.
2016/0319610 A1 11/2016 Magnuson
2016/0376808 A1 12/2016 Magnuson et al.
2017/0096866 A1 4/2017 Magnuson
2017/0157210 A1 6/2017 Magnuson
2017/0209889 A1 7/2017 Magnuson et al.
2017/0254162 A1 9/2017 Magnuson
2017/0268298 A1 9/2017 Magnuson et al.

* cited by examiner

MODULAR GRIPPERHEAD WITH EFFECTOR FOR A RACKER SYSTEM

PRIORITY

The present disclosure claims priority to and the benefit of U.S. Provisional Patent Application 62/418,488, filed Nov. 7, 2016, the entire contents which are incorporated herein by reference.

TECHNICAL FIELD

The present disclosure is directed to systems, devices, and methods for the manipulation, assembly and moving of tubulars within a derrick or mast in oil and gas drilling systems. More specifically, the present disclosure is directed to systems, devices, and methods for gripping and manipulating tubulars on a drilling rig using a modular gripperhead with an effector.

BACKGROUND OF THE DISCLOSURE

The exploration and production of hydrocarbons require the use of numerous types of tubulars also referred to as pipe. Tubulars include but are not limited to drill pipes, casings, and other threadably connectable elements used in well structures. Strings of joined tubulars, or drill strings, are often used to drill a wellbore and, with regards to casing, prevent collapse of the wellbore after drilling. These tubulars are normally assembled in groups of two or more, commonly known as "stands" to be vertically stored in the derrick or mast. The derrick or mast may include a storing structure commonly referred to as a fingerboard. Fingerboards typically include a plurality of vertically elongated support structures or "fingers" each capable of receiving a plurality of "stands."

Rotary drilling and top drive drilling systems often use these stands, instead of single tubulars, to increase efficiency of drilling operations by reducing the amount of connections required to build the drill string in or directly over the wellbore. However, the manipulation of tubulars from a horizontal to a vertical position, assembly of the stands, and presentation of the stands between the fingerboard and the well-center are dangerous and can be rather inefficient operations. When the stands are stacked densely in the fingerboard, it is difficult to select, or secure, a stand from the stack of stands using the gripper. Moreover, the different sized stands, based on their diameter for the proper securing of stands, require different sized gripperheads to accommodate different ranges. As most gripperheads are hydraulically actuated, the removal and replacement with a different gripperhead can take hours to complete due to connecting and disconnecting the hydraulic connections. Thus, traditional gripperheads are time consuming and laborious to change.

The present disclosure is directed to a drilling rig transportation system and methods that overcome one or more of the shortcomings in the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
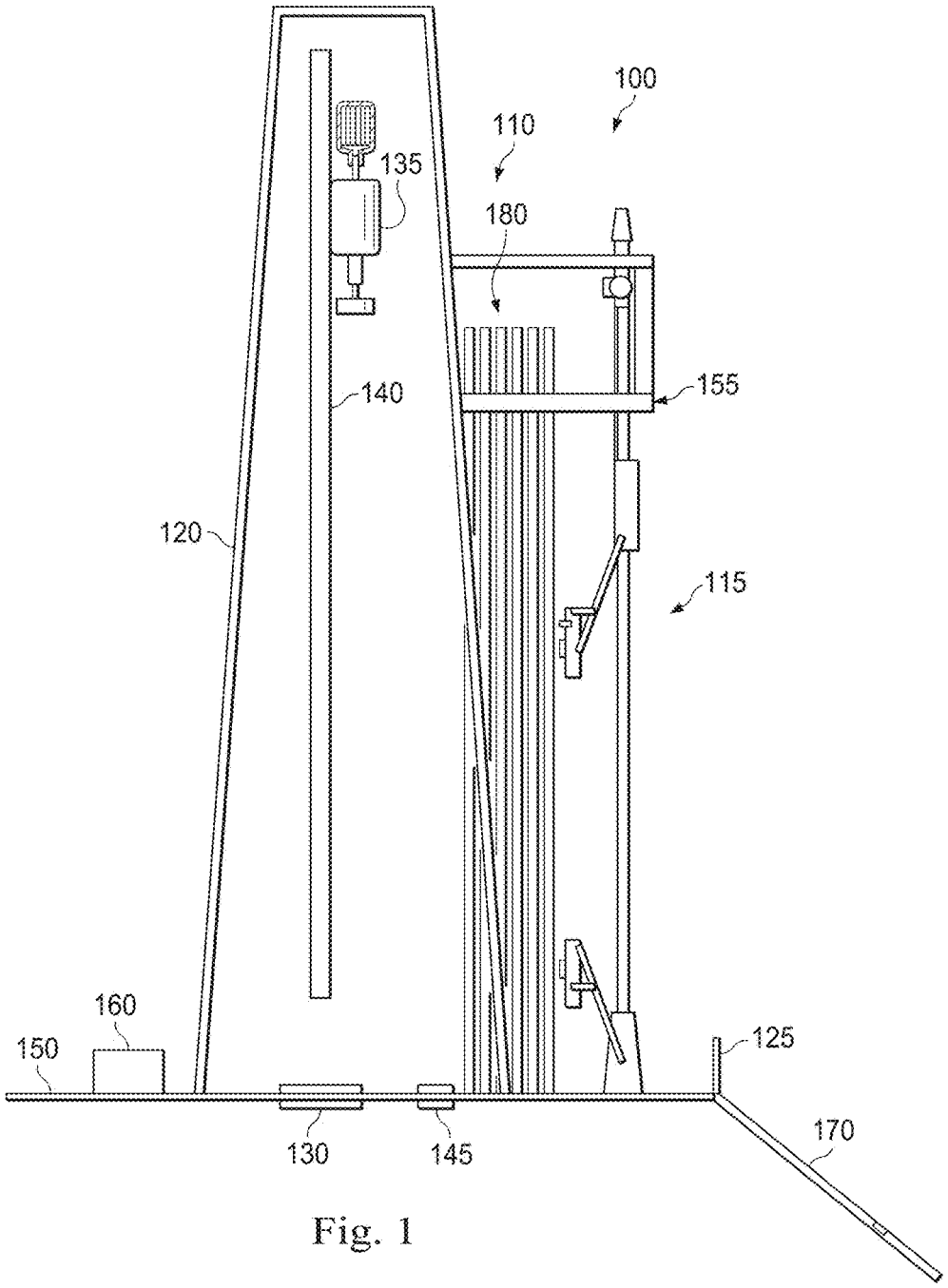
FIG. 1 is a schematic of an exemplary drilling rig according to one or more aspects of the present disclosure.

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The systems, devices, and methods described herein relate to a drilling rig apparatus that includes a modular tubular gripperhead system with an end effector or grabber arm. The gripperhead system may connect and disconnect to the remainder of the racker device in a manner that simplifies the changing of the gripperhead to accommodate tubulars or casing having different external diameters. The modules may be moved as a part of the drilling rig apparatus from one drilling location to another drilling location, or may be moved from one drilling rig apparatus to a separate other drilling rig apparatus. Since the gripperhead system comprises modules, the setup and tear down may be accomplished in a minimal amount of time, decreasing down time required between moves. In addition, because the gripperhead system is modular, one module may replace a worn or unusable module in a minimal amount of time. This may reduce the amount of time required for repairs and, likewise, may increase productivity.

This disclosure discusses components that are permanently fixed together to form a module of the gripperhead system. As used herein, the term "permanently fixed" means that the components are mechanically fixed or maintained together as an assembly and are intended to stay fixed or maintained together during connection or disconnection with the remainder of a racker device and stay fixed or maintained together during operation of the gripperhead system or drilling rig. The components may be in either direct contact or indirect contact. The term "permanently fixed" does not mean that the components are unable to be disassembled for other purposes such as repair of worn or broken elements, for permanent takedown, cleaning, refurbishing, recycling, or other purposes.

FIG. 1 is a schematic of a side view an exemplary drilling rig apparatus 100 according to one or more aspects of the present disclosure. In some examples, the drilling rig apparatus 100 may form a part of a land-based, mobile drilling rig. The drilling rig apparatus 100 may have a drill floor size of about 35×35 feet, although larger and smaller rigs are contemplated. In some embodiments, the drilling rig apparatus 100 may have a drill floor size of less than approximately 1,540 square feet. In other embodiments, the drilling rig apparatus 100 may have a drill floor size of less than approximately 1,720 square feet.

The drilling rig apparatus 100 shown in FIG. 1 includes rig-based structures 110 and a modular racker system 115 that operates on the rig-based structures 110. The rig-based structures 110 include, for example, a foundational chassis or rig frame (not shown), a mast 120, and a v-door 125 into the drilling rig apparatus 100. The v-door 125 may be arranged to receive tubulars or stands introduced to the drilling rig apparatus 100. In an embodiment, the mast 120 is disposed over and about a well-center 130 and supports a plurality of drilling components of a drilling system, shown here as a top drive 135 and its components disposed and moveable along a support column 140. Other drilling components are also contemplated.

This embodiment includes an offline mouse hole 145 that may be used to assemble tubulars into stands at a location spaced apart from the well-center 130 so as to not interfere with drilling at the well-center 130. In some embodiments, the mouse hole 145 is located above a shallow hole below a rig floor 150 that is offline from the well-center 130, where individual tubulars may be assembled together into stands, e.g. a plurality, such as three tubulars together that are then racked in a fingerboard 155 for later use or storage. The racker system 115 is described in greater detail below.

A rig control system 160 may control the racker system 115 and other rig components, while also communicating with sensors disposed about the drilling rig apparatus 100. The rig control system 160 may evaluate data from the sensors, evaluate the state of wear of individual tubulars or stands, and may make recommendations regarding validation of tubulars for a particular use as a part of a drilling operation. In some embodiments, the rig control system 160 may be disposed on the rig apparatus 100, such as in a driller's cabin, may be disposed in a control truck off the rig apparatus 100, or may be disposed elsewhere about the drilling site. In some embodiments, the rig control system 160 is disposed remote from the drilling site, such as in a central drill monitoring facility remote from the drill site.

A catwalk 170 forms a part of the drilling rig apparatus 100 and may be directly attached to or disposed adjacent the rig floor 150. The catwalk 170 allows the introduction of drilling equipment, and in particular tubulars or stands, to the v-door 125 of the drilling rig apparatus 100. In some embodiments, the catwalk 170 is a simple, solid ramp along which tubulars may be pushed or pulled until the tubular can be grasped or secured by the racker system 115. In other embodiments, the catwalk 170 is formed with a conveyer structure, such as a belt-driven conveyer that helps advance the tubulars toward or away from the drilling rig apparatus 100. Other embodiments include friction reducing elements, such as rollers, bearings, or other structures that enable the tubulars to advance along the catwalk toward or away from the v-door 125. It should be noted that where land rigs utilize catwalks, offshore rigs utilize conveyors to transport tubulars from the pipe deck to the rig floor 150. Therefore, it should be understood that description of the present disclosure use in a land rig may also be utilized in an offshore rig.

Figure 2:
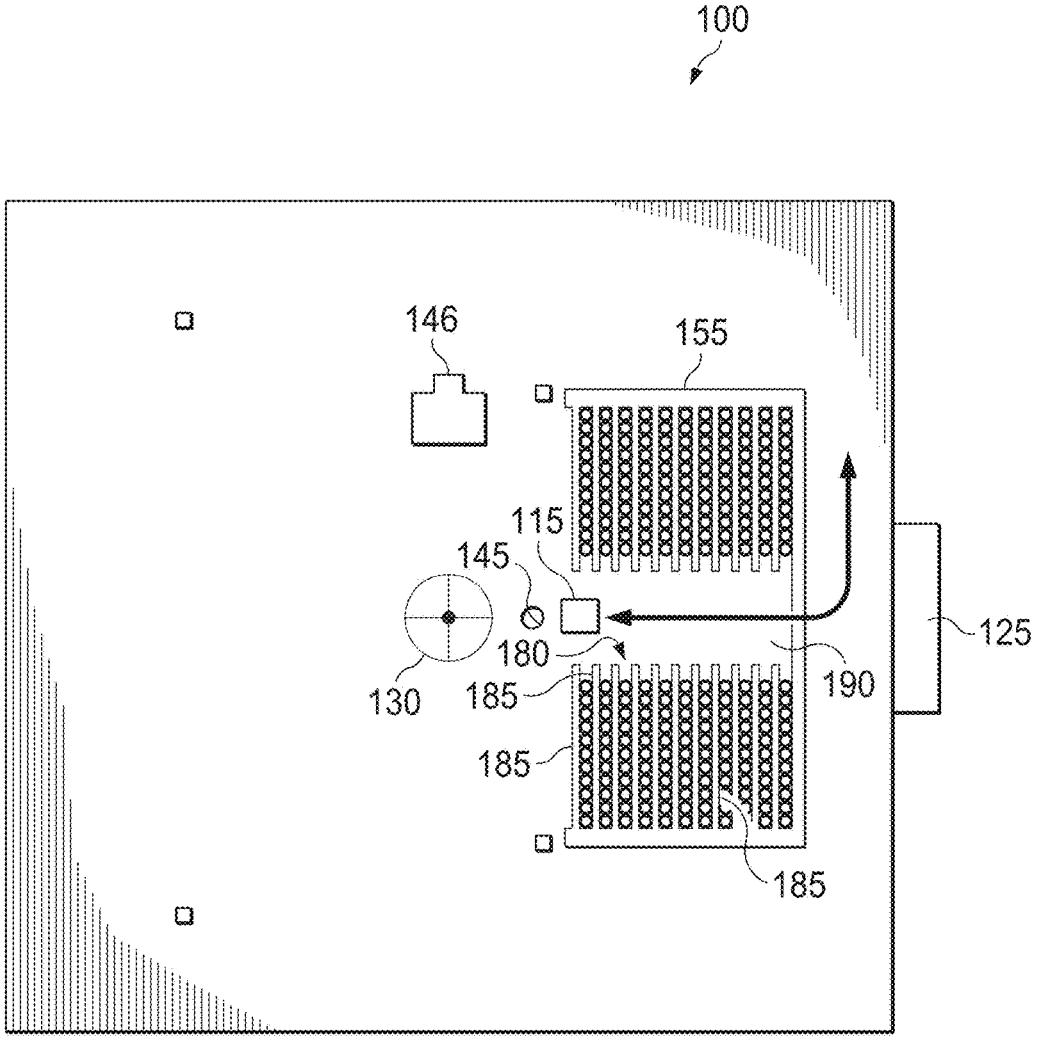
FIG. 2 is a schematic top view of an exemplary drilling rig according to one or more aspects of the present disclosure.

FIG. 2 is a schematic of top view of the exemplary drilling rig apparatus 100 according to one or more aspects of the present disclosure. FIG. 2 illustrates the fingerboard 155 and other portions of the racker system 115, the stands 180, fingers 185 forming a part of the fingerboard 155, an iron roughneck 146, the mouse hole 145, and the well-center 130, all as generally described above. The iron roughneck 146 may be moved about the drilling rig and may be used to connect and disconnect tubulars or stands at either or both of the well-center 130 and the mouse hole 145. A passageway 190 may extend between opposing sides of the fingerboard 155 between the v-door 125 and the well-center 130. The racker system 115 may travel along the passageway 190 indicated by the arrow in FIG. 2 to manipulate tubulars or stands between the fingerboard 155, the mouse hole 145, the well-center 130, and the v-door 125, and it may travel laterally to a position, such as a parking position, out of the passageway and out of the pathway between well-center 130 and the v-door 125.

Figure 3:
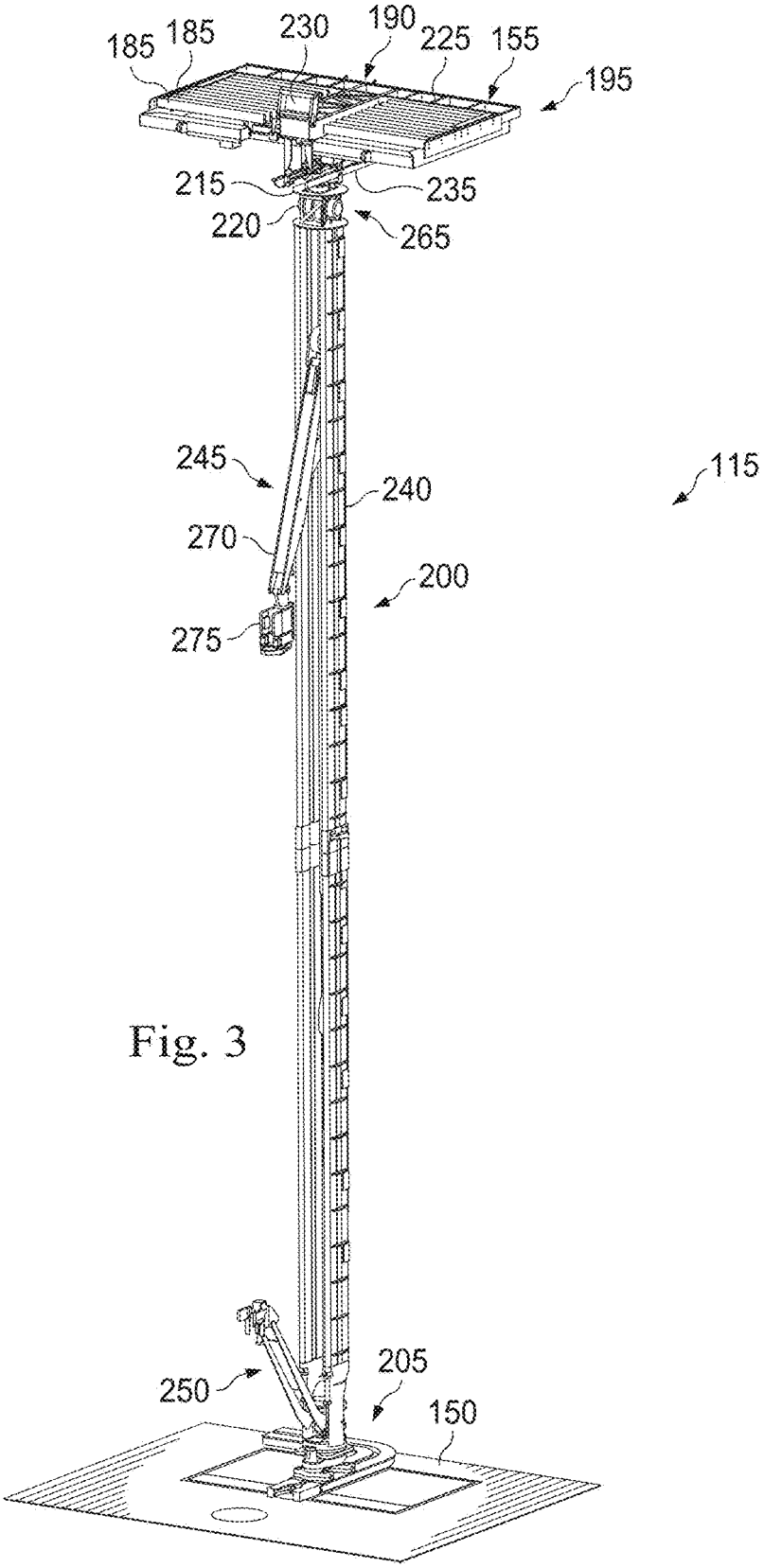
FIG. 3 a schematic of a perspective view of an exemplary racker system according to one or more aspects of the present disclosure, the racker system including a gripperhead.

FIG. 3 shows the racker system 115 in greater detail. It includes an upper track module 195, a racker column module 200, and a lower track module 205. In FIG. 3, the upper track module 195, the racker column module 200, and the lower track module 205 are shown connected in place.

The modules may be separated from one another for transport to a new location while still substantially maintaining their own respective assembled states. In some embodiments, however, the modules may still require some level of packing or unpacking, such as folding or collapsing to a more compact state for transport, and unfolding or extending for reuse. Because of this, the modules may also be easily and quickly interchanged with other similar modules, such as by including quick release components to attach and retain modules to each other, and quick connectors or fittings to permit simple "plug n' play" or snap in systems with electrical and hydraulic connectors. This may help expedite repairs, because a replacement module may be introduced in place of an older worn or broken module, and the worn or broken module may be removed and entirely fixed offline while the new module is used to keep the racker system 115 and the drilling rig apparatus 100 in operation.

In another embodiment, the replacement module is swapped in during transport of the modules from one rig or rig site to another.

The upper track module 195 includes, for example, the fingerboard 155, upper rails 235, a rotational union 215 for the column structure, and a festoon system 220.

The fingerboard 155 is a holding or storage area for stands that have been or will be used to build the drill string. These stands may be stored in the fingerboard 155 until they are used or broken down for removal from the drilling rig apparatus 100. The fingerboard 155 includes an outer support frame 225 having a plurality of individual fingers 185 extending in a parallel direction and cantilevered from the support frame 225. The upper portions of the stands may be inserted between the fingers 185 and thereby held in place, in a substantially vertical position for storage. As can be seen, in this embodiment, the fingerboard 155 includes a left side and a right side, with the passageway 190 therebetween. A support structure 230 extends from the support frame 225 along the passageway 190 and supports upper rails 235. In some embodiments, the fingerboard 155 of the upper track module 195 is arranged and configured to attach to and be supported by the mast 120 (FIG. 1). In some examples, it is cantilevered from the mast and extends over a portion of the rig floor 105. Other embodiments include a support structure, such as a derrick that supports the fingerboard 155 and the upper track module 195.

The upper rails 235 are, in this exemplary embodiment, suspended from the support structure 230 of the fingerboard 155 and form an upper track for an upper cart housing. The upper rails 235 are permanently fixed to the fingerboard 155, and therefore are not disconnected from the fingerboard 155 during rig assembly, disassembly, or during transport. Accordingly, when the fingerboard 155 is attached to the mast 120, there is little or no additional work or effort required to assemble and attach the upper rails 235. The upper rails 235 extend along the passageway 190 between opposing sides of the fingerboard between the v-door 125 and the well-center 130 (FIGS. 1 and 2). In the embodiment shown, the upper rails 235 curve or extend to a position outside the passageway 190 so that the upper cart housing can travel to a position that may be used to park the racker column module 200 to the side of the passageway 190 between the v-door 125 and the well-center 130. Accordingly, the upper rails 235 in this embodiment form an L-shape. Here, there are two upper rails 235, however, other embodiments include additional or fewer rails, or include other structures such as the upper track.

The upper track module 195 is configured to move the upper portion of the racker column module 200 along the upper rails 235. The upper track module 195 may include rollers, sliding pads, or other structures that facilitate movement of the racker column module 200 between the v-door 125, the mouse hole 145, and the well-center 130 below the mast 120.

The racker column module 200, includes a column 240, a middle arm assembly 245, a lower arm assembly 250, a housing (not labeled), and a motor and braking system (not labeled). The racker column module 200 extends between and connects with the upper track module 195 and the lower track module 205.

The column 240 of the racker column module 200 provides rigidity and support to the racker system 115, provides structural support of the middle and lower arm assemblies 245, 250, and connects the upper track module 195 to the lower track module 205. The column 240 may be formed of a single solid beam or a plurality of beams joined together end to end. In some embodiments, the column 240 includes two parallel plates, spaced apart to hold the middle and lower arm assemblies 245, 250 therebetween.

In this example, a hoisting system 265 is disposed at the top end of the column 240 and receives electric or hydraulic operating power from cables or hoses carried on the upper track module 195. The hoisting system 265 may include a cable extending to the middle arm assembly 245 and may be used to raise and lower the middle arm assembly 245 along the column 240.

The middle arm assembly 245 slides vertically along the support column 140 and may be extended or manipulated to grasp the upper end of tubulars, carry, move or otherwise displace a tubular/stand. In some embodiments, the middle arm assembly 245 may move upward or downward on rollers, slide pads, or other elements disposed on the column 240 or carried on the middle arm assembly. The lower arm assembly 250 is, in the exemplary embodiment shown, pivotably attached in place on the lower portion of the column 240.

The middle arm assembly 245 and the lower arm assembly 250 are configured to reach out to insert a drill pipe stand into or remove a drill pipe stand from the fingerboard 155. That is, they extend outwardly from the column 240 to clamp onto or otherwise secure a drill pipe stand that is in the fingerboard 155 or to place a drill pipe stand in the fingerboard 155. In addition, the middle arm assembly 245 and the lower arm assembly 250 are configured to reach out to receive tubulars introduced to the drilling rig apparatus 100 through the v-door 125 and to carry tubulars or stands from the v-door 125 or the fingerboard 155 to the mouse hole 145 or to the well-center 130 for hand-off to the drilling elements, such as the top drive 135. As indicated above, the middle arm assembly 245 may move vertically up and down along the racker column 240. In some aspects, it is operated by the hoisting system 265.

The middle arm assembly 245, which may be considered the gripperhead system, includes a manipulator arm or gripper arm 270 and a gripperhead 275. Generally, the gripperhead 275 is sized and shaped to open and close and to grasp or retain tubing, such as tubulars or stands. The gripper arm 270 may move the gripperhead 275 toward and away from the column 240.

Figure 4:
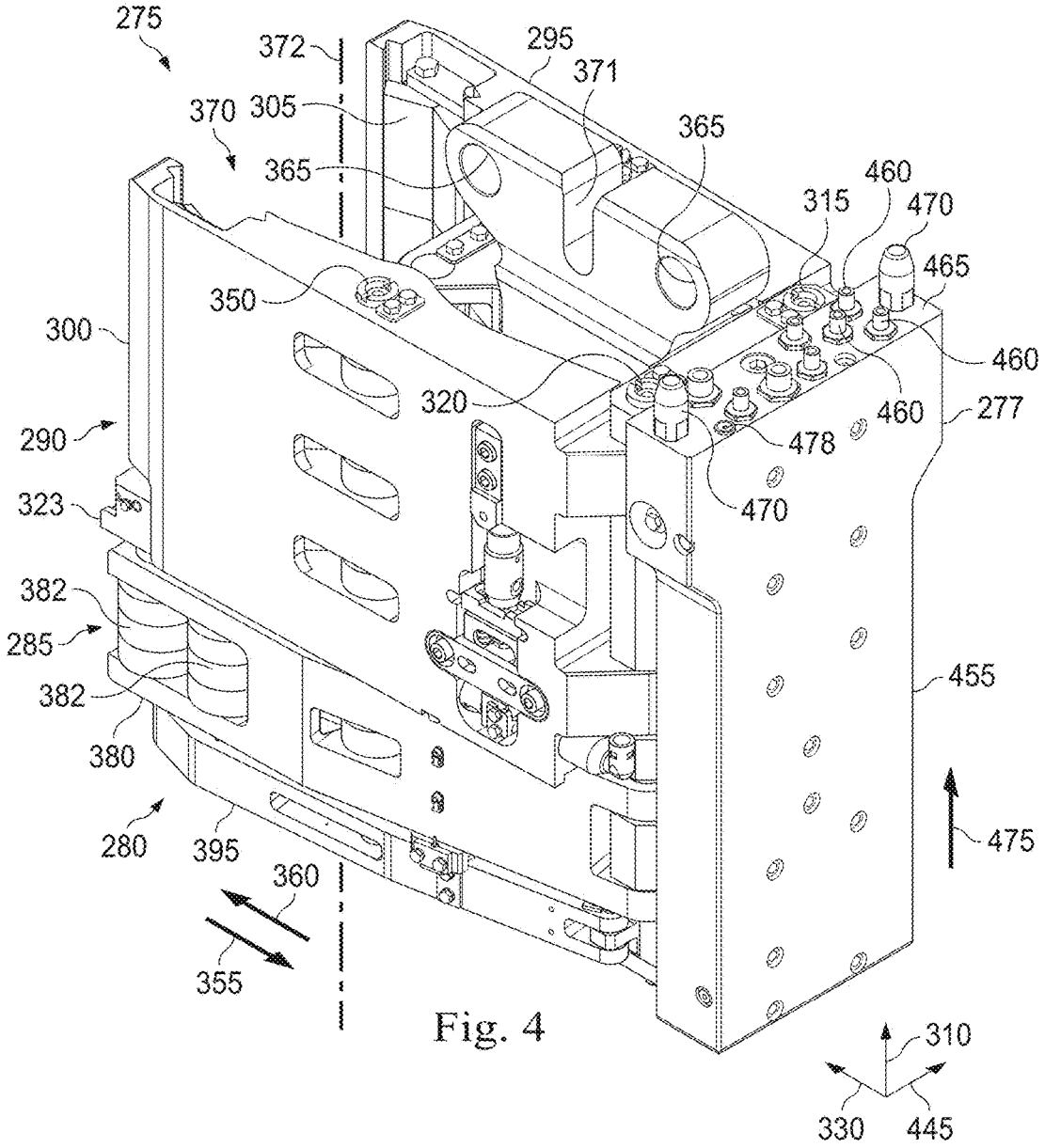
FIG. 4 is a perspective view of the gripperhead of FIG. 3 according to one or more aspects of the present disclosure.
Figure 5:
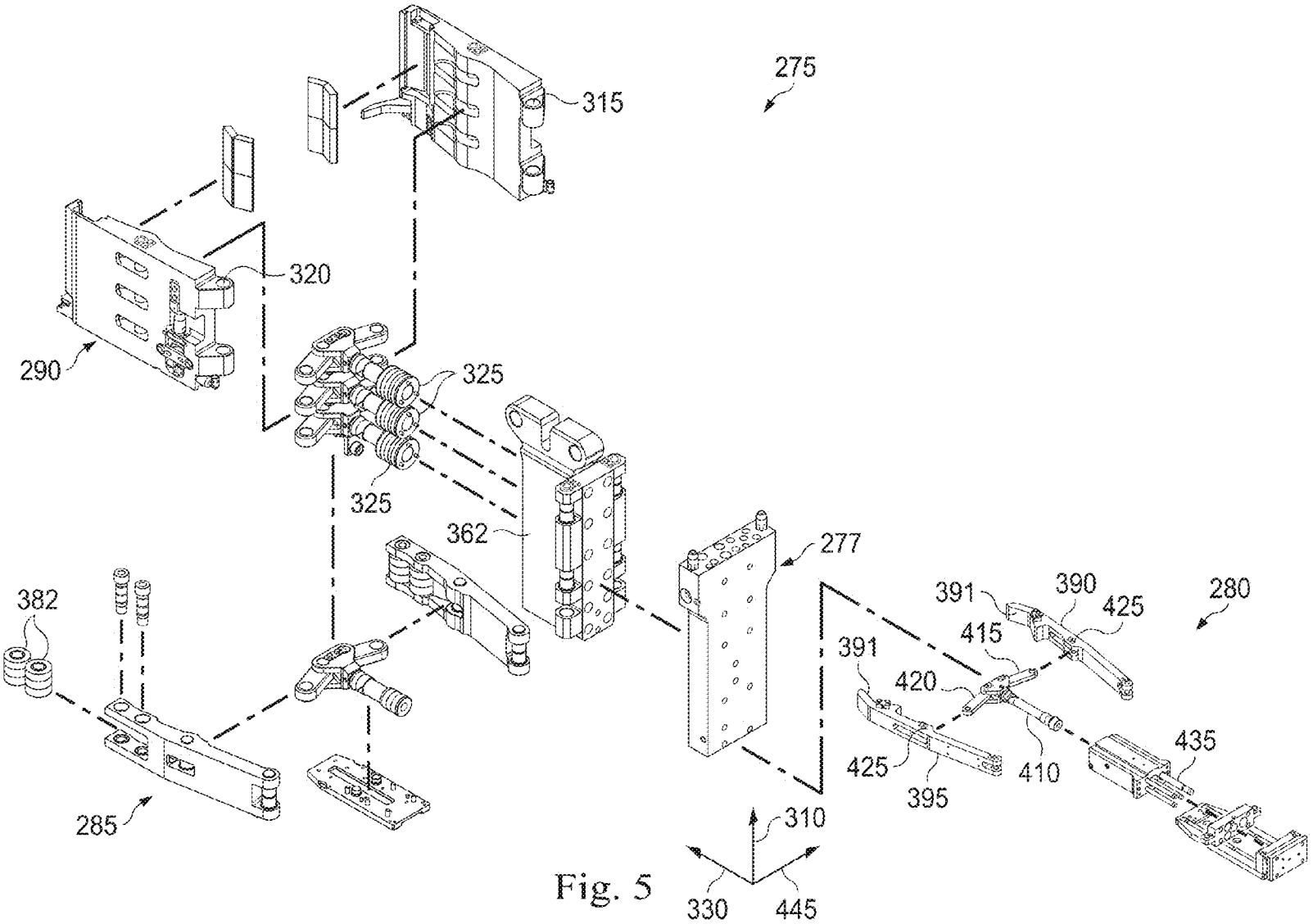
FIG. 5 is a perspective, exploded view of the gripperhead of FIG. 3 according to one or more aspects of the present disclosure.

FIGS. 4-5 show the gripperhead 275 in greater detail. Generally, the gripperhead 275 is an articulated system that includes an effector, or a grabber 280 to select, secure, and pull a tubular towards the gripperhead 275. The gripperhead 275 also includes a centralizer 285 that centralizes the tubular secured by the grabber 280. The gripperhead 275 also includes a gripper 290 that also secures the tubular for movement of the tubular. The gripperhead 275 also includes a hydraulic manifold assembly 277 that is fluidically and/or electrically coupled to each of the grabber 280, the centralizer 285, and the gripper 290.

Figure 6:
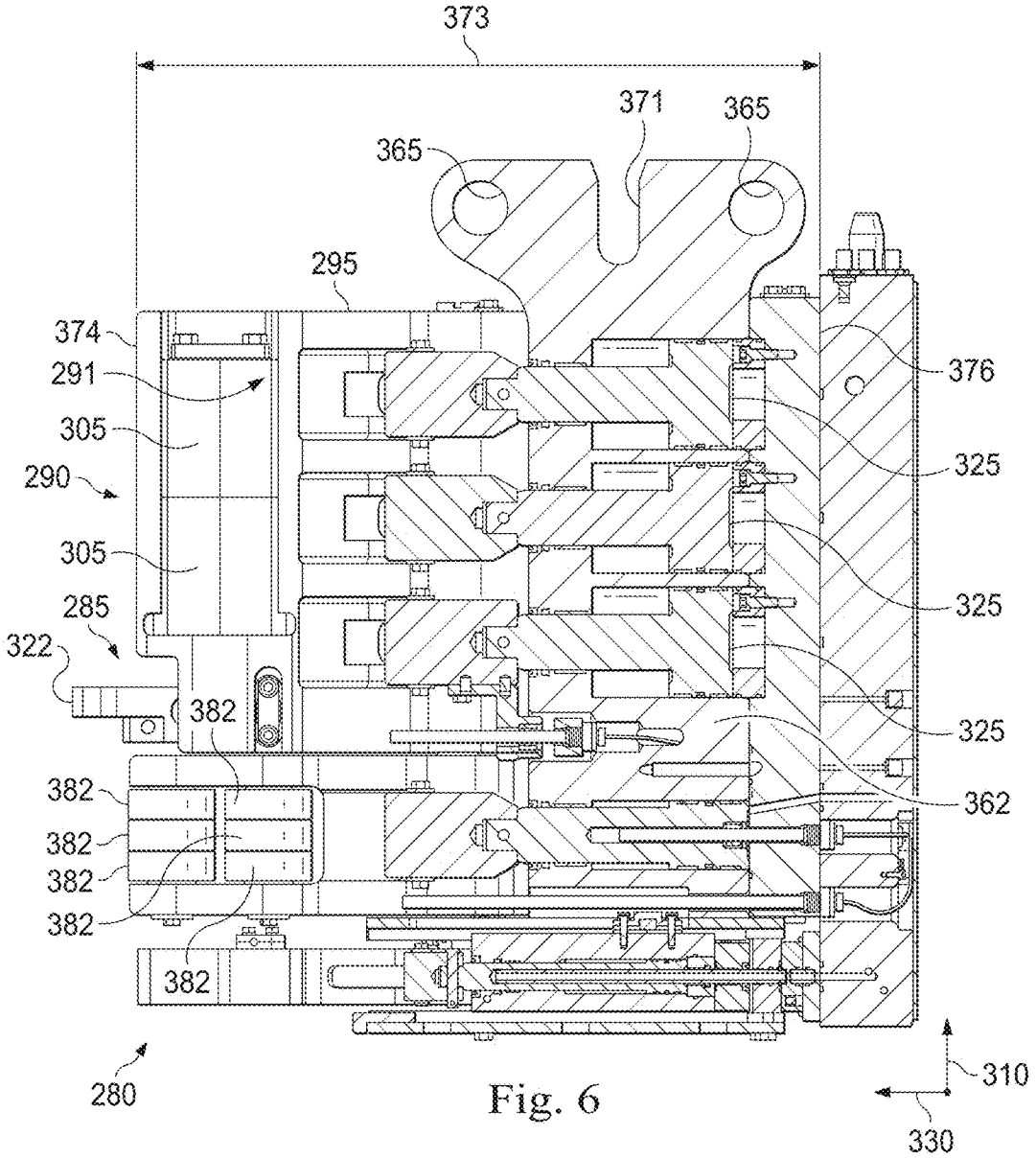
FIG. 6 is a sectional, perspective view of the gripperhead of FIG. 3 according to one or more aspects of the present disclosure.
Figure 7:
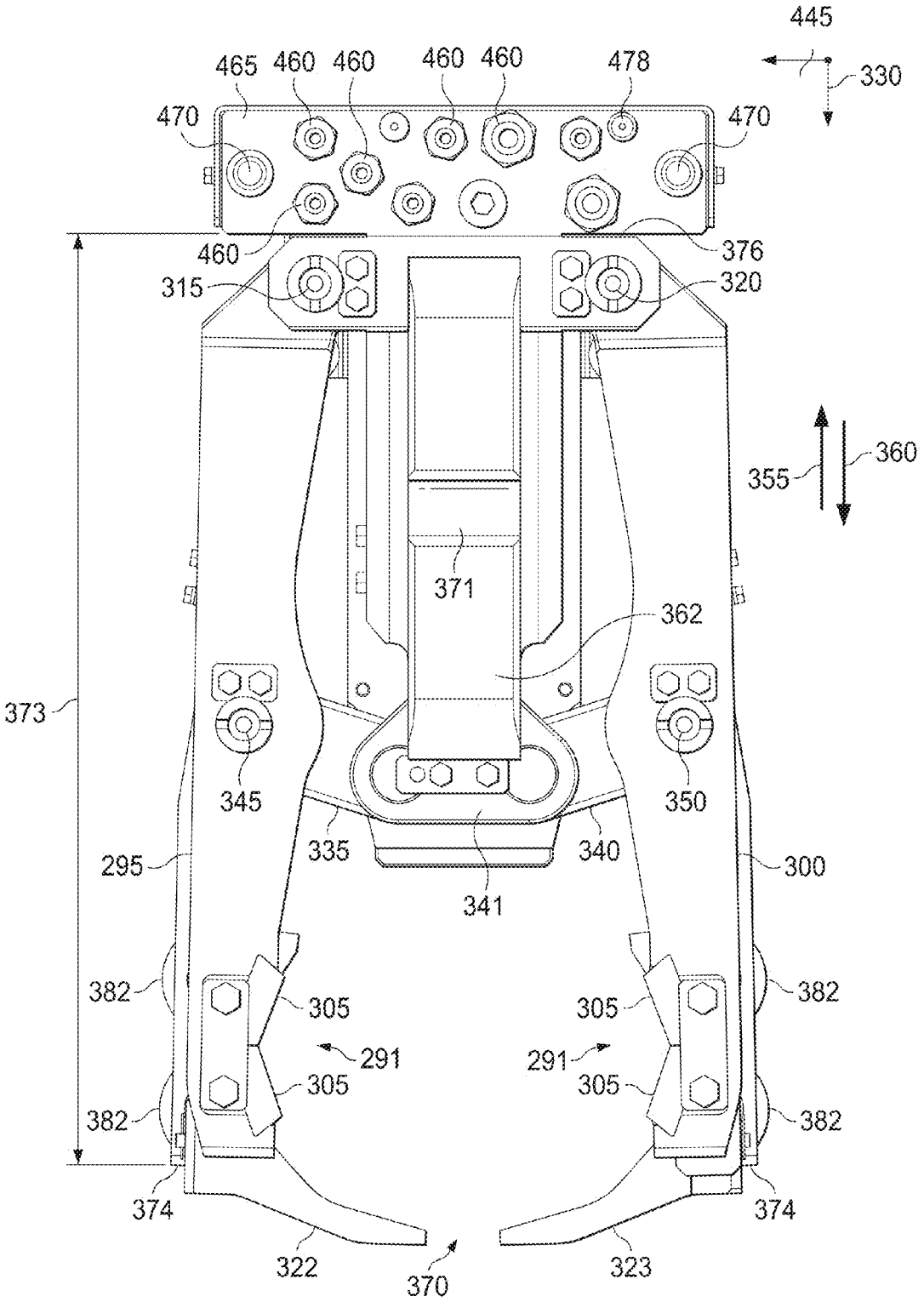
FIG. 7 is a top view of the gripperhead of FIG. 3 according to one or more aspects of the present disclosure.

As shown in FIGS. 4 and 6-7, the gripper 290 includes a first gripper arm 295 and a second opposing gripper arm 300. Each of the gripper arms 295 and 300 includes an inwardly facing gripping surface 291. The inwardly facing gripping surfaces 291 may include a plurality of v-shaped dies 305 that are coupled to an inward (surface of the gripper arms 295 and 300 that faces the other) surface of the gripper arms 295 and 300 along an axis parallel to and represented by the arrow having the numeral 310 in FIG. 4 ("axis 310"). The v-shape of the dies helps center a tubular between the gripping surfaces. This axis is shown and represented by the axis 372 in FIG. 4. Each of the gripper arms 295 and 300 pivot about a pivot point 315 and 320, respectively. When pivoting about the pivot points 315 and 320, the gripper arms 295 and 300 move between an open position and a closed position.

In some exemplary embodiments, the gripper 290 also includes a first locking arm 322 and a second opposing locking arm 323 (FIG. 7) that rotate between a locked position where each locking arm 322 and 323 is in a generally horizontal position as shown in FIG. 7 and an open position when the longitudinal axis of each locking arm 322 and 323 is in a generally vertical position (not shown). When in the locked position, the locking arms 322 and 323 are configured to retain the tubular within the gripper arms 295 and 300. Likewise, when in the open position, the locking arms 322 and 323 are rotated 90 degrees to provide access into the chamber 370. Generally, the locking arms 322 and 323 are hydraulically driven to the open position and spring driven back to a closed position. Accordingly, in an implementation having locking arms 322, 323, the locking arms 322 and 323 may rotatably pivot about pivot points 324 and 326 (FIG. 8) between a horizontal direction and a substantially vertical direction. Many embodiments do not include the locking arms 322 and 323.

The gripper 290 also includes a plurality of hydraulically actuated pistons 325, with each piston extending along an axis parallel to the arrow having the numeral 330 in FIG. 4 ("axis 330"). In this exemplary implementation, two pivotable arms 335 and 340 are coupled to a link 341 disposed at one end of each piston 325 and are coupled to either the first gripper arm 295 (about pivot point 345) or the second gripper arm 300 (about pivot point 350). Thus, the arms 295 and 300 are pushed apart when the plurality of hydraulically actuated pistons 325 retract in a first direction 355 along the axis 310 and are pulled together when the plurality of pistons 325 extend, or stroke out, in a second direction 360 that is opposite from the first direction 355. It should be noted that in other embodiments, the pivotable arms 335 and 340 and the link 341 may be arranged to push apart the arms 295 and 300 when the pistons 325 advance and to pull the arms 295 and 300 together when the pistons 325 retract. The pistons 325 extend through a generally longitudinally extending (in the axis 310) body 362.

An upper portion of the body 362 forms two bores 365 and a longitudinally extending (in the direction of the axis 310) slit 371 sized to receive a corresponding portion of the gripper arm 270. The gripper arm 270 forms two corresponding bores (not shown) to the bores 365. A pin (not shown) extends through each of the bores 365 and the bores in the gripper arm 270 when the gripper arm 270 is secured to the gripperhead 275. Generally, the gripper 290 closes to apply a sufficient force to the tubular accommodated within the gripper arms 295 and 300 so that the gripperhead 275 can hoist and otherwise manipulate the tubular, whether horizontal to vertical or vertical to horizontal manipulation, or manipulation in some other direction. The gripper 290 has a dimension 373 defined in the direction of the axis 330. The dimension 373 is defined by a front-most surface 374 of the gripper 290 in the second direction 360 and a back-most surface 376 in the first direction 355. Generally, the inwardly facing gripping surfaces form at least a portion of a receiving chamber 370 having a longitudinal axis 372 (FIG. 4) that is parallel or concentric to the axis 310.

Figure 8:
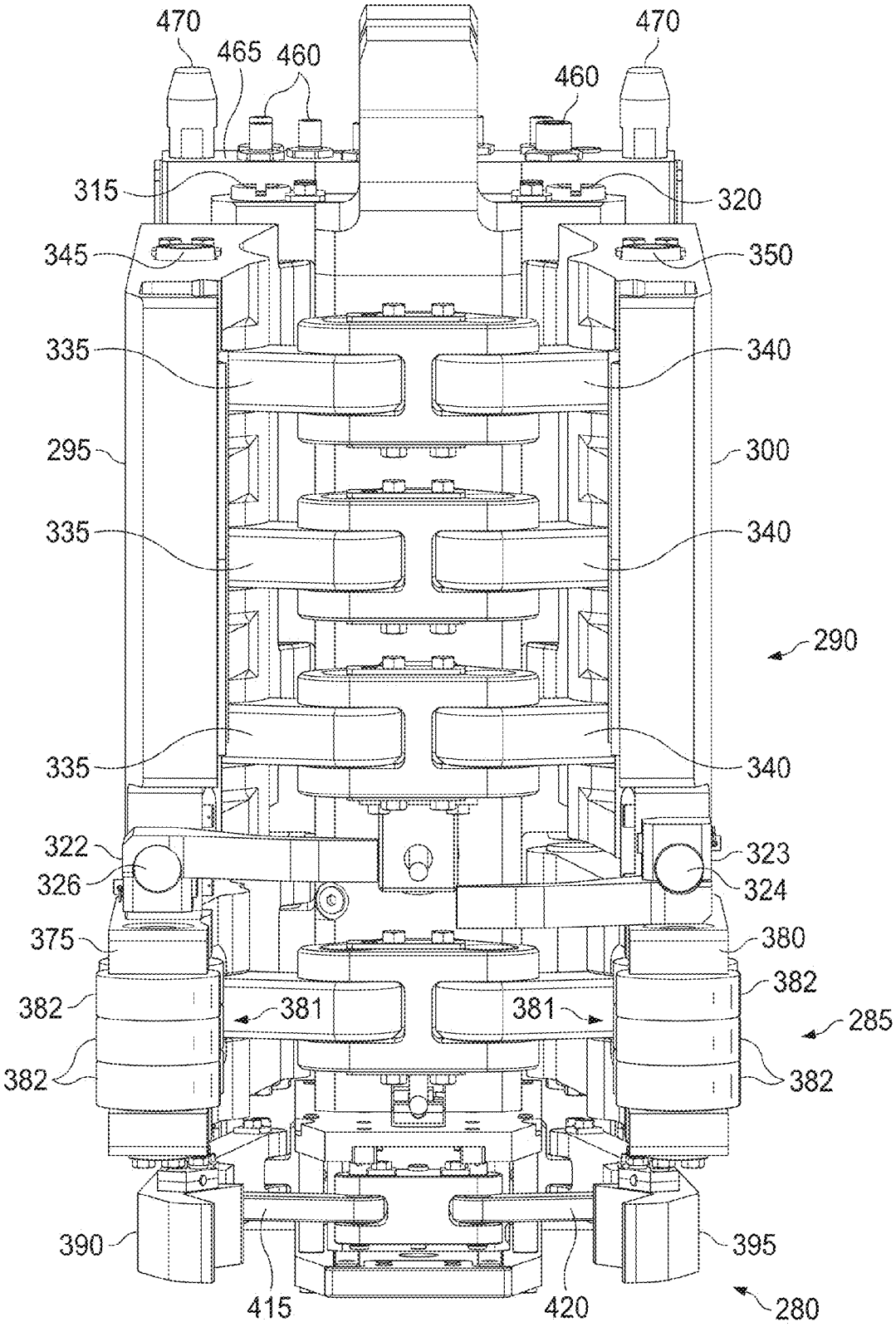
FIG. 8 is another perspective view of the gripperhead of FIG. 3 according to one or more aspects of the present disclosure.
Figure 9:
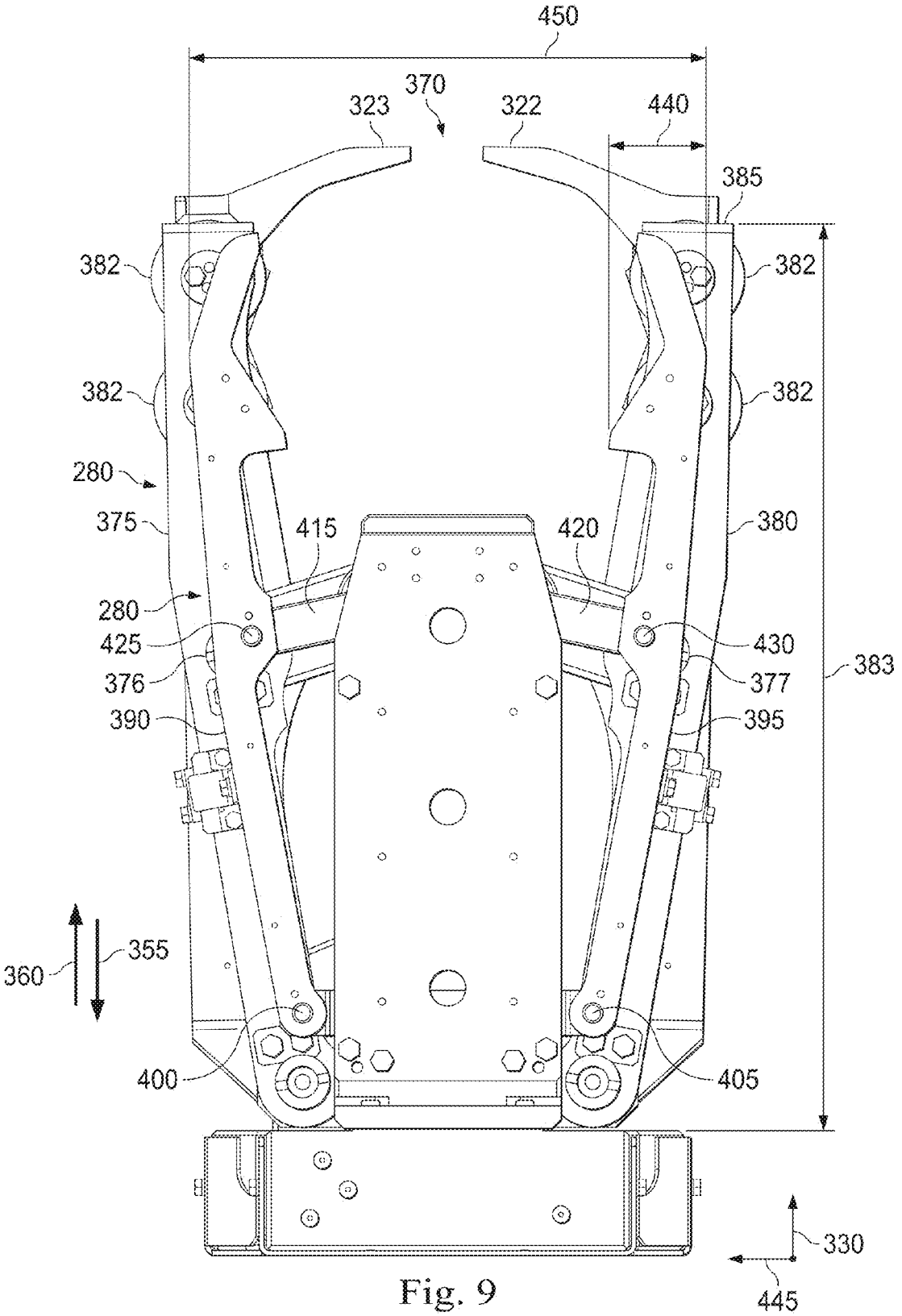
FIG. 9 is a bottom view of the gripperhead of FIG. 3 according to one or more aspects of the present disclosure.

As shown in FIGS. 8-9, the centralizer 285 includes a first centering arm 375 and an opposing second centering arm 380. Each of the centering arms 375 and 380 includes an inwardly facing gripping surface 381. The inwardly facing gripping surfaces 381 may include a plurality of rollers 382 spaced along the axes 330 and axis 310. The first and second centering arms 375 and 380 are movable between a "closed" and "open" position in a similar manner to the arms 295 and 300. That is, the first and second centering arms 375 are also pivotable about the pivot points 315 and 320, respectively. The first and second centering arms 375 are also movable due to a piston that is coupled to two pivotable arms, with one arm pivotable about the pivot point 345 and the other pivotable about the pivot point 350. Generally, the centralizer closes to grip the tubular and centralize the tubular. The centralizer 285 also allows for the rotation of the tubular within the centralizer 285 when the centralizer 285 is in a closed position. The centralizer 285 defines a dimension 383 defined in the axis 310. The dimension 383 is at least in part defined by a front-most surface 385 of the centralizer 285 in the second direction 360 and a back-most surface in the first direction 355.

Figure 5A:
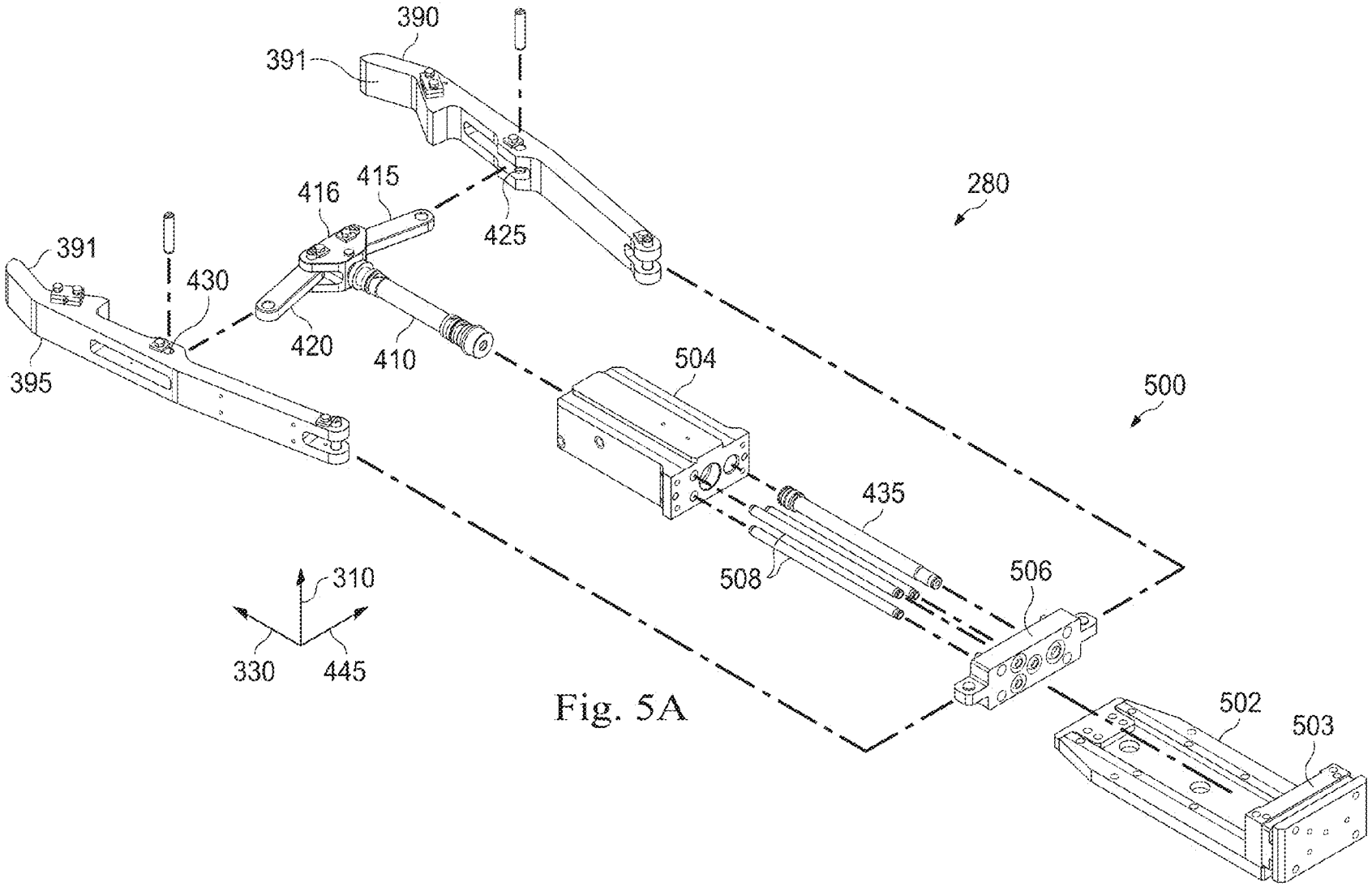
FIG. 5A is an enlarged portion of the exploded view of FIG. 5, according to one or more aspects of the present disclosure.

The grabber 280 includes a first grabber arm 390 and a second opposing grabber arm 395. In the implementation shown, the grabber 280 is disposed directly below the centralizer 285, which in turn is directly below the gripper 290. Each of the grabber arms 390 and 395 includes an inwardly facing gripping surface 391. The inwardly facing gripping surfaces 391 may be a concave or generally v-shaped surface. In some implementations, the gripping surface 391 of the grabber arms 390 and 395 aligns with the dies 305 on the gripper arms of the gripper 290. Each of the grabber arms 390 and 395 pivot about a pivot point 400 and 405, respectively. When pivoting about the pivot points 400 and 405, the gripper arms 390 and 395 move between an open position that may allow a tubular to enter or be removed from the chamber 370 and a closed position that may secure the tubular in the gripper head. Similar to the centralizer 285, the grabber 280 includes a hydraulically actuated piston 410 (FIGS. 5 and 5A) with a link 416 to which two pivotably bars 415 and 420 are pivotably coupled. The bar 415 is coupled to the arm 390 at a pivot point 425 and the bar 420 is coupled to the arm 395 at a pivot point 430. Also similar to the centralizer 285 and the gripper 290, closing the grabber arms 390 and 395 secures the tubular within the grabber 280.

In addition, the first and second arms 390 and 395 extend, or move, in a direction parallel to or along the axis 310 in the direction 360. The arms 390 and 395 extend in the direction 360 such that at least a portion of the arms 295 and 300 selectively extend beyond, in the direction 360, the front-most surface 385 of the centralizer 285, the front-most surface 374 of the gripper 290, or both. Thus, the grabber 280 is configured to extend beyond the gripper 290 and the centralizer 285. Generally, the portion of the arms 295 and 300 that extend beyond the front-most surfaces and 385 and 374 has a width 440 that is measured approximately along an axis represented by the arrow having the numeral 445 (FIG. 9). Generally, the width 440 of each arm 390 and 395 may be within a range of about 1.0-1.5 inches. In some implementations, the width 440 is approximately 1.5 inches, may be approximately 1.25 inches, 1.1 inches, or 1 inch. In an exemplary embodiment, the width 440 of each arm 390 and 395 is dependent upon the dimensions of the fingers 185 (FIG. 2) in the fingerboard such that the each arm 390 and 395 is sized to extend between rows of racked stands. The width 440 of each arm 390 and 395 may be any dimension in the range between about 2 inches and about 0.5 inches. In other embodiments, the width 440 of each arm may be greater than 2 inches. In an exemplary embodiment, the width 440 of each arm 390 and 395 is sized to be the same as or less than the width of a finger 185. Generally, each of the gripper arms 295 and 300 and each of the centering arms 375 and 380 defines a width greater than the width 440, such that the width of the gripper arms to 95 and 300 is less than a width of the centering arms 375 and 380. Using the middle arm assembly 245 (FIG. 3) of the column sacker allows the grabber arms 390 and 395 to select and grab a tubular or stand in a pack of tightly packed tubulars or stands when the width of the gripper arms 295 and 300 and the width of the centering arms 375 and 380 are too large to extend between tubulars that are densely racked. Thus, the middle arm assembly 245 allows the grabber arms 390 and 395 to extend between tubulars that are densely racked, which is the traditional method of racking in modular land rigs to minimize space utilization. Moreover, the grabber arms 390 and 395 together may define a dimension 450 along the same axis as the width 440. In one exemplary embodiment, and when in the open position, the dimension 450 is less than the total width of two fingers 185 and a spacing formed between two consecutively spaced fingers 185. A hydraulically actuated piston 435 (FIG. 5) pushes the arms 390 and 395 in the direction 360 and retracts the arms 390 and 395 in the direction 355. In the retracted position, and as shown in FIG. 9, the grabber arms 390 and 395 are not extending beyond the front-most surfaces 385 and 374.

The grabber 280, with the grabber arms 390 and 395, selectively advance and retract to grasp a tubular and pull it into the jaws of the gripper 290 and the centralizer 285. In some implementations, the grabber arms 390 and 395 project forwardly beyond the leading end surfaces of the gripper 290 and the centralizer 285 by a distance at least the width of a tubular. In some implementations, the grabber arms 390 and 395 project forwardly a distance in a range of about 3 to 8 inches, although larger and smaller distances are contemplated.

To selectively and simultaneously advance and retract both the grabber arms 390 and 395, the grabber 280 may include an advancement and retraction assembly 500. The advancement and retraction assembly 500 may be configured to advance not only the grabber arms 390 and 395, but also the piston 410 and the link 416 and bars 415 and 420 and all the components that enable the grabber arms 390 and 395 to open and close. In some implementations, the assembly 500 includes a track 502 with a base support 503, a sled 504, a seal block 506, and a plurality of conduit rods 508. The advancement and retraction assembly may advance the sled 504 along the track 502 in the direction of the axis 310 using hydraulics or other displacement force. The sled 504 in this instance is a manifold. The seal block 506 may be secured to the sled 504, and the piston 435 and the plurality of conduit rods 508 may extend through the seal block 506 and attach to the base support 503. This plurality of conduit rods may telescope within the sled 504 as the sled 504, seal block 506, grabber arms 390 and 395, and other supported components forwardly advance and retract relative to the track 502 with its base support 503, which may be rigidly fixed to the manifold assembly 277 (FIG. 5). Hydraulics may be used to open and close the grabber arms 390 and 395 and to advance and retract the grabber arms 390 and 395. In this implementation, the sled 504 may carry the piston 14 and other components that enable the grabber arms 390 and 395 to open and close. FIGS. 4, 6, and 7 show the grabber 280 in the retracted position.

Referring back to FIG. 4, the hydraulic manifold assembly 277 includes a body 455 having a generally rectangular box-like shape. However, the body 455 may form any shape. The hydraulic manifold assembly 277 includes a plurality of hydraulic "quick connect" coupling ports 460 on a top surface 465 of the body 455. Quick connect coupling ports may include snap in connectors or fitting. Generally, the number of ports 460 is dependent upon the number of hydraulically actuated pistons within the gripperhead 275. Referring back to FIGS. 4, 5, and 7, eight ports 460 extend from the body 455 in a direction represented by the arrow having the numeral 475 in FIG. 4 ("the direction 475"). The number of ports 460 depends upon the design and functionality of the gripperhead 275. In the exemplary embodiment described, two ports provide hydraulic fluid flow for the centralizer 285, two ports provide hydraulic fluid flow for the gripper 290, and four ports provide hydraulic fluid flow for the grabber 280. In this implementation, because the grabber 280 both opens and closes and extends and retracts, it uses additional hydraulics. Other embodiments may have other arrangements. The hydraulic manifold assembly 277 may also include one or more electrical quick connects on the top surface 465, with the electrical quick connects configured to mate with a corresponding electrical connection on the gripper arm 270.

One or more guides 470 also extend from the body 455 in the direction 475. Generally, the guides 470 are sized to corresponding with mating bores (not shown) in the gripper arm 270. Together, the slit 371 and guides 470 are self-guiding couplers in that when the slit 371 receives the corresponding portion of the gripper arm 270 and the guides 470 are received in corresponding mating bores of the gripper arm 270, each of the hydraulic ports 460 is aligned with a corresponding hydraulic connector/port located on the gripper arm 270. Alignment of the bores 365 with the corresponding bores on the gripper arm 270 results in fluidically coupling the ports 460 with the corresponding hydraulic connector located on the gripper arm 270 and electrically coupling the gripper arm 270 with the gripperhead 275. Removal of the pins or other fasteners from bores 365 of the body 362 will release the gripper arm 270 from the gripperhead 275 and, due to the quick connect hydraulic connectors, each of the hydraulic ports 460 is simultaneously or near simultaneously disconnected from the corresponding hydraulic connectors on the gripper arm 270. Moreover, the gripper arm 270 is electrically decoupled from the gripperhead 275 simultaneously or near simultaneously to the hydraulic decoupling of the gripperhead 275 from the gripper arm 270. In an exemplary embodiment, the hydraulic manifold assembly 277 may also include a proximity sensor 478 located on the top surface 465 (or elsewhere) such that the gripper arm 270 can "read" or otherwise determine, based on the sensor 478, information regarding the gripperhead 275, such as the range of outer diameters for which the gripperhead 275 can accommodate. In some implementations, the grabber arms 390 and 395 include tapered leading tips that may be tapered to better penetrate spaces between adjacent tubulars. This may allow the grabber arms 390 and 395 to more easily grasp tubulars in the fingerboard 155.

In some implementations, the hydraulic and electrical connections are rigidly, plumbed into place so that alignment and attachment of the gripperhead 275 simultaneously aligns and attaches the hydraulic and electrical connections. In other implementations, the hydraulic and/or electrical connections are cables and hoses that require manual connection. Even in such embodiments, attachment is simplified compared to conventional systems because the ports are all or substantially all aligned along a single side of the hydraulic manifold assembly 277. This enables faster, more convenient setup than previously known systems. In addition, this enables simple disconnect and replacement of a gripperhead assembly.

Figure 11:
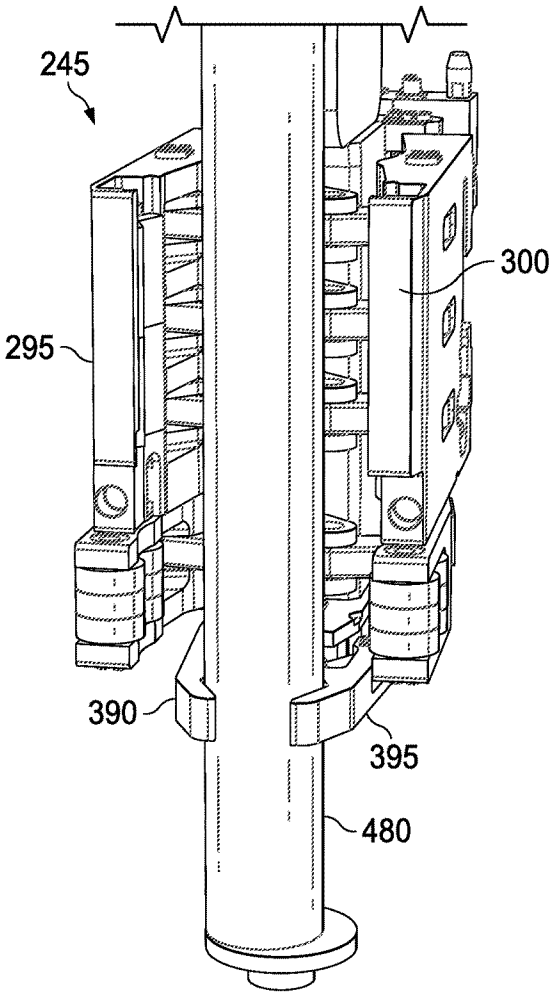
FIG. 11 is a perspective view of the gripperhead of FIG. 3 and a tubular during steps of a method.
Figure 10:
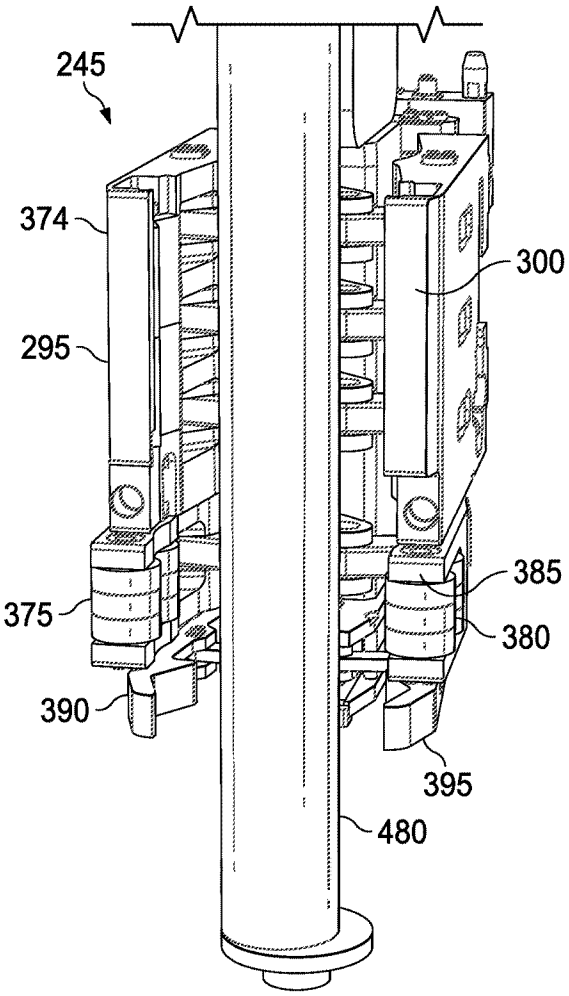
FIG. 10 is a perspective view of the gripperhead of FIG. 3 and a tubular during steps of a method.

Referring to the FIGS. 10-15, a method of manipulating a tubular using the middle arm assembly 245 includes positioning the middle arm assembly 245 in proximity to a tubular 480. As shown in FIG. 10, and when the middle arm assembly 245 is positioned in proximity to the tubular 480, the gripper arms 295 and 300 are in the open position, the centering arms 375 and 380 are in the open position, and the grabber arms 390 and 395 are in the open position. In some implementations, positioning the middle arm assembly 245 in proximity to the tubular includes positioning the middle arm assembly 245 in proximity to a fingerboard that accommodates the tubular 480 and another tubular that is spaced from the tubular 480 by a finger 185. The method also includes extending the grabber arms 390 and 395 in the direction 360 while the grabber arms 390 and 395 are in an open position. This may include displacing the grabber 280, with the first and second grabber arms in a direction transverse to the longitudinal axis defined by the receiving chamber 370 of the gripper 290. Accordingly, each grabber arm displaces from a retracted position to an extended position. As shown in FIGS. 10 and 11, the grabber arms 390 and 395 are in the extended position where they are moved in the direction 360 to pass beyond the front-most surface 374 of the gripper 290 and the front-most surface 385 of the centralizer 285. The grabber arms 390 and 395 are also in the open position sized to permit a portion of the tubular to enter the chamber. In this position, the grabber arms 390 and 395 may able to extend between adjacent tubulars disposed in a racking board that may be inaccessible by the larger gripper head as a whole or by the gripper 290. Accordingly, the method may include introducing the grabber arms 390 and 395 between adjacent tubulars in the racking board sufficiently far to grasp the tubular with the grabber arms 390 and 395.

Figure 12:
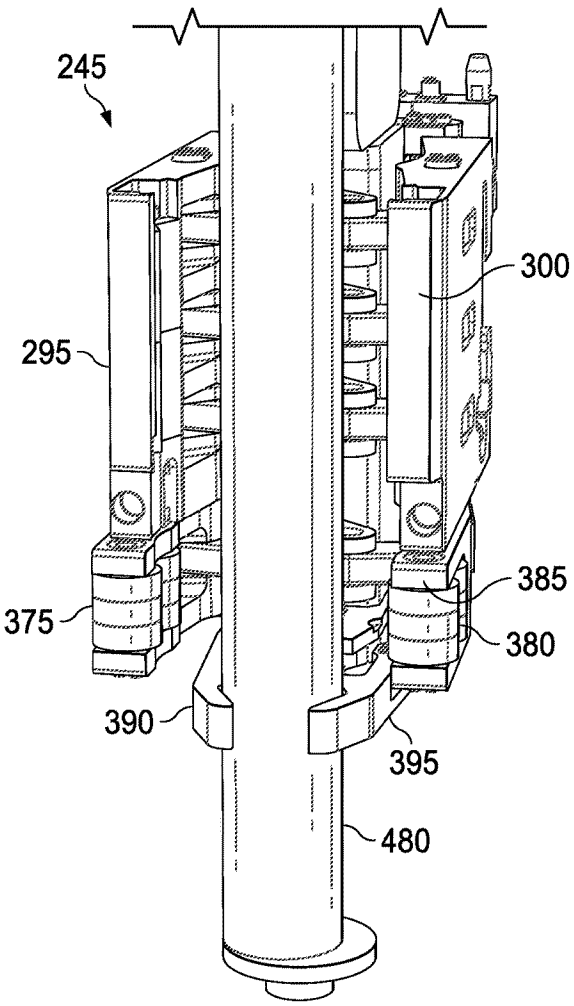
FIG. 12 is a perspective view of the gripperhead of FIG. 3 and a tubular during steps of a method.

The method also includes closing the grabber arms 390 and 395 to secure the tubular 480 within the grabber arms 390 and 395. As shown in FIG. 12, with the grabber arms 390 and 395 in the closed position and gripping the tubular, the method may also include pulling the tubular 480 towards the centralizer 285 and the gripper 290 in the direction 355. In so doing, some method implementations include displacing the tubular carried by the grabber arms 390 and 395 out of the position where it was located in the rackingboard, and moving the tubular toward the gripper head and into the receiving chamber in the gripperhead.

Figure 13:
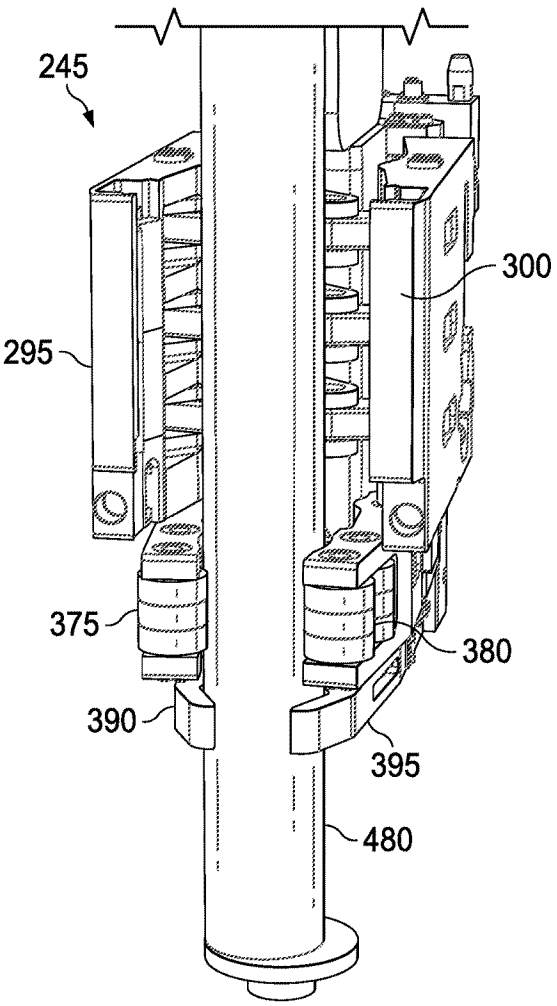
FIG. 13 is a perspective view of the gripperhead of FIG. 3 and a tubular during steps of a method.
Figure 15:
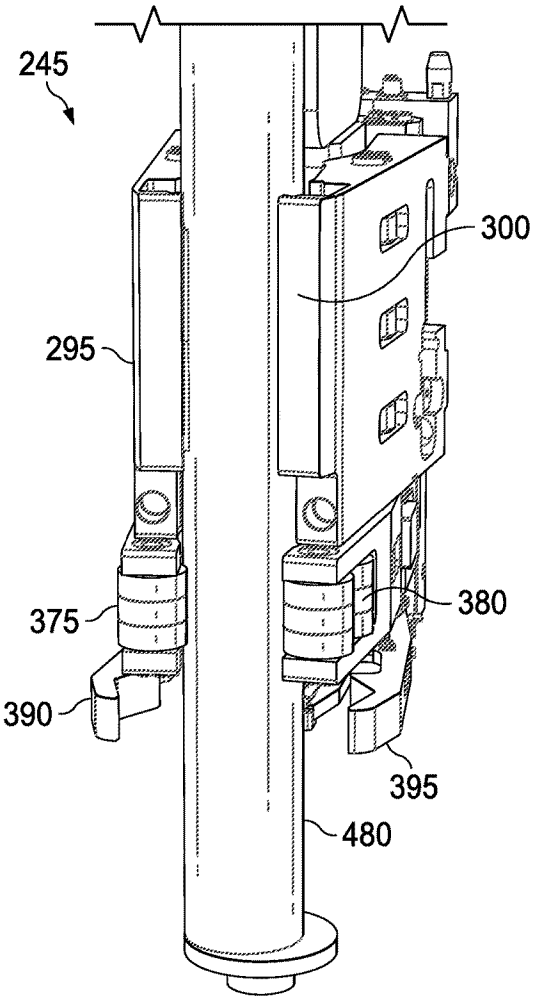
FIG. 15 is a perspective view of the gripperhead of FIG. 3 and a tubular during steps of a method.
Figure 14:
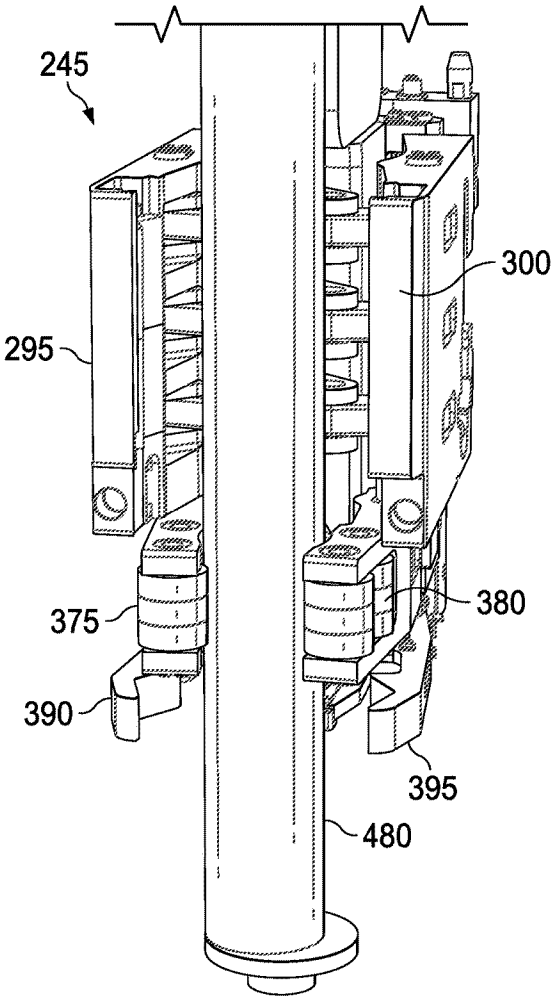
FIG. 14 is a perspective view of the gripperhead of FIG. 3 and a tubular during steps of a method.

As shown in FIG. 13, the method also includes closing the centering arms 375 and 380 of the centralizer 285 to center the tubular 480 relative to the centralizer 285 and the gripper 290. Centering the tubular 480 relative to the centralizer 285 may include aligning a longitudinal axis of the tubular 480 and the longitudinal axis of the receiving chamber formed by the gripper arms 295 and 300. In some embodiments, the tubular 480 is allowed to rotate while secured in the centralizer 285. This may allow makeup and breakdown of tubulars by threading tubulars together. In these circumstances, the tubular may be held only by the centralizer 285. As shown in FIG. 14, the method also may include opening the grabber arms 390 and 395 while the tubular is secured in the closed centering arms 375 and 380. The method also includes, as shown in FIG. 15, closing the gripper arms 295 and 300 to secure the tubular 480 prior to moving or otherwise manipulating the tubular 480. When the tubular 480 is secured and/or suspended in the gripper arms 295, the middle arm assembly 245 of the racker device can move the tubular 480 from vertical to horizontal or from horizontal to vertical. The method can also be performed in reverse to release the tubular 480 that is secured in the gripper arms 295 and 300.

In the exemplary implementations described herein, the grabber 280, the centralizer 285, and the gripper 290 each operate independently of each other. That is, the centralizer 285 may be closed while the gripper 290 and the grabber 280 are open. Similarly, the gripper 290 may be closed while the centralizer 285 and the grabber 280 are open. As described below, the grabber 280 may be closed and may manipulate a tubular into the chamber of the gripperhead while the centralizer 285 and gripper 290 are open.

Often, the type or size of tubular that is being manipulated by the middle arm assembly 245 changes. As such, the outer diameter of the tubular changes. In response, the gripperhead 275 is changed to accommodate the change in outer diameter of the tubular. Thus, a variety of gripperheads 275, each sized to accommodate a size or range of sizes of tubulars, may be installed or removed from the gripper arm 270. Due to the self-aligning coupler and hydraulic quick connects, the average time to change a gripperhead is about 5 minutes-compared to hours using conventional gripperheads. As such, the gripperhead 275 a modular gripperhead 275 that allows for the quick and efficient changing of the gripperhead 275.

Generally, each of the axes 310, 330, and 445 is perpendicular to each of the other axes 310, 330, and 445. In one embodiment, the gripper 290, is located above the centralizer 285 in the direction 475, the centralizer 285 is located above the grabber 280 in the direction 475, and the hydraulic manifold assembly 277 is located beside, along the axis 310, each of the gripper 290, the centralizer 285, and the grabber 280. However, a variety of arrangements are contemplated herein.

The interfacing connection between the gripper arm 270 and the gripperhead 275 is selectively attachable so that during operation they are fixed together, yet can be disconnected from each other so that the gripperhead 275 may be quickly removed and replaced.

While the modules described herein have certain components associated therewith, it should be understand that the modules may be arranged so that different components form a part of different modules.

In view of all of the above and the figures, one of ordinary skill in the art will readily recognize that the present disclosure introduces a modular gripperhead for gripping a tubular for a drilling process that includes a gripper having a first gripper arm and a second opposing gripper arm, each gripper arm having an inwardly facing gripping surface that forms at least a portion of a chamber sized to receive a portion of a cylindrical tubular, wherein the portion of the chamber has a longitudinal axis. The modular gripperhead may also include a grabber having a first grabber arm and a second grabber arm, each grabber arm being displaceable between a retracted position and an extended position in a direction along a first axis that is transverse to the longitudinal axis, wherein each of the first and second grabber arms is pivotable about a first and second pivot point, respectively, and between an open position sized to permit a portion of a cylindrical tubular to enter between the first and the second grabber arms and a closed position sized to secure a portion of a cylindrical tubular between the first and the second grabber arms.

The modular gripper head also includes a centralizer arranged to manipulate a tubular held by one of the gripper and the first and second grabber arms, the centralizer including a first centering arm and an opposing second centering arm, each centering arm positioned to pivot about a third and fourth pivot point, respectively, and between an open position sized to permit a portion of a cylindrical tubular to enter the chamber and a closed position sized to secure a portion of a cylindrical tubular in the chamber. Each of the first centering arm and the opposing second centering arm includes a plurality of rollers. The gripper has a dimension measured between a front-most surface and a back-most surface along the first axis; and wherein, when the first and second grabber arms are in the extended position, the first and second grabber arm extend beyond the front-most surface along the first axis. When in the extended position, only a portion of each of the first and second grabber arms extends beyond the front-most surface along the first axis; the portion of each of the first and second grabber arm has a width measured along a second axis that is perpendicular to both the longitudinal axis and the first axis; and the width is greater than about 0.75 inches and less than about 2 inches. In some aspects, the modular gripperhead also comprises a hydraulic manifold assembly that is configured to actuate each of a plurality of hydraulic functions. In some aspects, the modular gripperhead includes a plurality of quick connect couplers on the hydraulic manifold assembly disposed to be connected to a support arm, wherein the plurality of quick connect couplers are on a top surface of the hydraulic manifold assembly. In some aspects, the receiving chamber is sized to accommodate a tubular and wherein the first and second grabber arm is sized to accommodate the tubular.

In another aspect, the present disclosure introduces a method of manipulating a tubular that includes positioning a gripper in proximity to the tubular, the gripper including a first gripper arm and a second opposing gripper arm, each gripper arm having an inwardly facing gripping surface that forms at least a portion of a receiving chamber; wherein the portion of the receiving chamber has a longitudinal axis; extending a first and second grabber arm of a grabber in a first direction that is perpendicular to the longitudinal axis such that a portion of the first and second grabber arms extends beyond an front-most surface of the gripper; and closing the first and second grabber arm to secure the tubular between the first and second grabber arms. The method also includes retracting the first and second grabber arms in a second direction opposite to the first direction to pull the tubular towards the gripper; and closing the first and second gripper arm to secure the tubular between the first and second gripper arms. Retracting the first and second grabber arms to pull the tubular towards the gripper includes positioning the tubular between a first centering arm and an opposing second centering arm of a centralizer; and wherein the method further includes closing the first centering arm and the opposing second centering arm to align a longitudinal axis of the tubular with the longitudinal axis of the receiving chamber of the gripper. The gripper, the grabber, and the centralizer form a modular gripperhead. The method also includes opening the first and second grabber arm of the grabber to release the tubular. The opening and closing of the first and second grabber arm includes actuating a first hydraulically actuated piston; and wherein retracting and extending the first and second grabber arm including actuating a second hydraulically actuated piston. The method also includes including suspending the tubular within the gripper.

In some exemplary aspects, the present disclosure is directed to an apparatus for manipulating a tubular, comprising: a gripper having a chamber sized to receive a portion of a cylindrical tubular, wherein the portion of the chamber has a longitudinal axis; a centralizer arranged to rotate a tubular in the chamber; and a grabber having a first grabber arm and a second grabber arm, each grabber arm being displaceable between a retracted position and an extended position in a direction along a first axis that is transverse to the longitudinal axis, wherein at least one of the first and second grabber arms is pivotable about a pivot point, and between an open position sized to permit a portion of a cylindrical tubular to enter the chamber and a closed position sized to secure a portion of a cylindrical tubular in the chamber. In some aspects, the gripper comprises a first arm and a second arm, the first and second arms being configured to secure the tubular in place.

In some aspects, the centralizer comprises a plurality of rollers configured to interface with and rotate the tubular about the axis. In some aspects, the gripper has a front-most surface and a back-most surface; and wherein, when the first and second grabber arms are in the extended position, the first and second grabber arm extend outwardly beyond the front-most surface. In some aspects, the apparatus includes an arm assembly on a racker device, a manifold fixed to the gripper and the centralizer, the manifold being attachable to the arm assembly on the racker device.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C, § 112(f) for any limitations of any of the claims herein, except for those in which the claim expressly uses the word "means" together with an associated function.

What is claimed is:

1. A gripperhead for gripping a tubular for a drilling process, comprising:

a gripper having a first gripper arm and a second opposing gripper arm, each gripper arm having an inwardly facing gripping surface that forms at least a portion of a chamber sized to receive a portion of the tubular, wherein the portion of the chamber has a longitudinal axis;

a grabber having a first grabber arm and a second grabber arm, each grabber arm being displaceable between a retracted position and an extended position in a direction along a first axis that is transverse to the longitudinal axis, wherein each of the first and second grabber arms is pivotable about a first and second pivot point, respectively, and between an open position sized to permit a portion of the tubular to enter between the first and the second grabber arms and a closed position sized to secure the portion of the tubular between the first and the second grabber arms;

a centralizer arranged to manipulate the tubular held by one of the gripper and the first and second grabber arms, the centralizer comprising a first centering arm and an opposing second centering arm, each centering arm positioned to pivot about a third and fourth pivot point, respectively, and between an open position sized to permit a portion of the tubular to enter the chamber and a closed position sized to secure a portion of the tubular in the chamber; and a hydraulic manifold assembly comprising a body extending parallel to the longitudinal axis of the chamber;

wherein each of the gripper, the grabber, and the centralizer are rigidly coupled to the body of the hydraulic manifold assembly; and wherein the grabber is displaceable between the retracted position and the extended position relative to the gripper and the body of the hydraulic manifold assembly.

2. The gripperhead of claim 1, wherein each of the first centering arm and the opposing second centering arm comprises a plurality of rollers.

3. The gripperhead of claim 1, wherein the gripper has a front-most surface and a back-most surface; and wherein, when the first and second grabber arms are in the extended position, the first and second grabber arm extend outwardly beyond the front-most surface.

4. The gripperhead of claim 3, wherein, when in the extended position, only a portion of each of the first and second grabber arms extends beyond the front-most surface along the first axis;

wherein the portion of each of the first and second grabber arm has a width measured along a second axis that is perpendicular to both the longitudinal axis and the first axis; and wherein the width is greater than about 0.75 inches and less than about 2 inches.

5. The gripperhead of claim 1, comprising a plurality of quick connect couplers on the hydraulic manifold assembly disposed to be connected to a support arm, wherein the plurality of quick connect couplers are on a top surface of the hydraulic manifold assembly.

6. The gripperhead of claim 1, further comprising an advancement and retraction assembly that moves the grabber relative to the body of the hydraulic manifold assembly;

wherein the advancement and retraction assembly comprises a first hydraulically actuated piston that is actuated using the hydraulic manifold assembly; and wherein the first hydraulically actuated piston moves the first grabber arm and the second grabber arm along the first axis.

7. The gripperhead of claim 6, wherein the advancement and retraction assembly further comprises:

a base support that is rigidly fixed to the body of the hydraulic manifold assembly; and a seal block configured to move along the first axis relative to the base support;

wherein the first hydraulically actuated piston extends through the seal block to attach to the base support;

wherein the first and second grabber arms is pivotable relative to the seal block about the first and second pivot point; and wherein the first hydraulically actuated piston moves the seal block along the first axis relative to the base support, the gripper, and the body of the hydraulic manifold assembly.

8. The gripperhead of claim 7, wherein the advancement and retraction assembly further comprises:

a manifold secured to the seal block and configured to move along the first axis relative to the base support; and a second hydraulically actuated piston that extends through the manifold and that is actuated using the hydraulic manifold assembly via the base support;

wherein the second hydraulically actuated piston moves along the first axis relative to the base support, the gripper, and the body of the hydraulic manifold assembly; and wherein the second hydraulically actuated piston moves each of the first and second grabber arms between the open position and the closed position.

9. A method of manipulating a tubular, the method comprising:

positioning a gripper in proximity to the tubular, the gripper comprising a first gripper arm and a second opposing gripper arm, each gripper aim having an inwardly facing gripping surface that forms at least a portion of a receiving chamber; wherein the portion of the receiving chamber has a longitudinal axis;

wherein the gripper is fixedly coupled to a hydraulic manifold assembly that comprises a body extending parallel to the longitudinal axis of the chamber;

extending, relative to the gripper and the body of the hydraulic manifold assembly, a first grabber arm and a second grabber arm of a grabber in a first direction that is perpendicular to the longitudinal axis such that a portion of the first and second grabber arms extends beyond a front-most surface of the gripper with the first and second grabber arms in an open position; and closing the first and second grabber arm to secure the tubular between the first and second grabber arms;

retracting, relative to the gripper and the body of the hydraulic manifold assembly, the first and second grabber arms to pull the tubular towards the gripper;

positioning the tubular between a first centering arm and an opposing second centering arm of a centralizer; and closing the first centering arm and the opposing second centering arm to align a longitudinal axis of the tubular with the longitudinal axis of the receiving chamber of the gripper.

10. The method of claim 9, the method further comprising:

closing the first and second gripper arms to secure the tubular between the first and second gripper arms.

11. The method of claim 10, wherein the gripper, the grabber, and the centralizer form a gripperhead.

12. The method of claim 10, further comprising suspending the tubular using the centralizer while allowing the tubular to rotate.

13. The method of claim 9, further comprising opening the first and second grabber arm of the grabber to release the tubular.

14. The method of claim 13, wherein the hydraulic manifold assembly further comprises a first and a second hydraulically actuated piston;

wherein the opening and closing of the first and second grabber arm comprises actuating the first hydraulically actuated piston; and wherein retracting and extending the first and second grabber arm comprising actuating the second hydraulically actuated piston.

15. An apparatus for manipulating a tubular, comprising:

a gripper having a chamber sized to receive a portion of the tubular, wherein the portion of the chamber has a longitudinal axis;

a centralizer arranged to allow the tubular to rotate in the chamber, the centralizer comprising a first centering arm and an opposing second centering arm, each centering arm positioned to pivot about between an open position sized to permit a portion of the tubular to enter the chamber and a closed position sized to secure a portion of the tubular in the chamber;

a grabber having a first grabber arm and a second grabber arm, each grabber arm being displaceable between a retracted position and an extended position in a direction along a first axis that is transverse to the longitudinal axis, wherein at least one of the first and second grabber arms is pivotable between an open position sized to permit a portion of the tubular to enter the chamber and a closed position sized to secure a portion of the tubular in the chamber;

a hydraulic manifold assembly comprising a body extending parallel to the longitudinal axis of the chamber;

wherein each of the gripper, the grabber, and the centralizer are rigidly coupled to the body; and wherein the grabber is displaceable between the retracted position and the extended position relative to the gripper and the body of the hydraulic manifold assembly.

16. The apparatus of claim 15, wherein the gripper comprises a first arm and a second arm, the first and second arms being configured to secure the tubular in place.

17. The apparatus of claim 15, wherein the centralizer comprises a plurality of rollers configured to interface with and allow the tubular to rotate about the longitudinal axis.

18. The apparatus of claim 15, wherein the gripper has a front-most surface and a back-most surface; and wherein, when the first and second grabber arms are in the extended position, the first and second grabber arm extend outwardly beyond the front-most surface.

19. The apparatus of claim 15, comprising:

an arm assembly on a racker device, wherein the hydraulic manifold assembly is attachable to and fluidly connectable to the arm assembly on the racker device.

* * * * *